US007451601B2

(12) United States Patent
Taware et al.

(10) Patent No.: US 7,451,601 B2
(45) Date of Patent: Nov. 18, 2008

(54) METHOD OF TUNING INDIVIDUAL COMBUSTION CHAMBERS IN A TURBINE BASED ON A COMBUSTION CHAMBER STRATIFICATION INDEX

(75) Inventors: Avinash Vinayak Taware, Niskayuna, NY (US); Vasanth Srinivasa Kothnur, Clifton Park, NY (US); Ajai Singh, Clifton Park, NY (US); Bruce Gordon Norman, Ballston Lake, NY (US); Jian Zhou, Shangai (CN)

(73) Assignee: General Electric Company, Schenectady, NY (US)

( * ) Notice: Subject to any disclaimer, the term of this patent is extended or adjusted under 35 U.S.C. 154(b) by 465 days.

(21) Appl. No.: 10/908,387

(22) Filed: May 10, 2005

(65) Prior Publication Data

US 2006/0254279 A1 Nov. 16, 2006

(51) Int. Cl.
*F02C 9/28* (2006.01)

(52) U.S. Cl. ..... 60/773; 60/39.281; 60/803

(58) Field of Classification Search ..... 60/39.281, 60/39.37, 773, 776, 803; 702/182, 183, 185
See application file for complete search history.

(56) References Cited

U.S. PATENT DOCUMENTS

| | | | | |
|---|---|---|---|---|
| 6,205,765 | B1 | 3/2001 | Iasillo et al. | |
| 6,955,039 | B2 | 10/2005 | Nomura et al. | |
| 6,979,118 | B1 | 12/2005 | Mick et al. | |
| 7,210,297 | B2 | 5/2007 | Shah et al. | |
| 7,269,939 | B2 * | 9/2007 | Kothnur et al. | 60/39.281 |
| 2002/0183916 | A1 | 12/2002 | Cleary | 701/100 |
| 2006/0090471 | A1 * | 5/2006 | Shah et al. | 60/803 |

* cited by examiner

*Primary Examiner*—Louis J Casaregola
(74) *Attorney, Agent, or Firm*—Cantor Colburn LLP

(57) ABSTRACT

A method, system and software for reducing combustion chamber to chamber variation in a multiple-combustion chamber turbine system comprising sensing dynamic combustion pressure tones emitted from combustion chambers in a multiple combustion chamber turbine and determining a combustion chamber stratification index for the combustion chambers from the dynamic combustion pressure tones emitted for the combustion chambers to record and/or tune combustion chamber performance variations in the multiple-chamber combustion turbine system.

17 Claims, 12 Drawing Sheets

CSI Estimation Scheme

Example CSI bases used to calculate CSI.

Example CSI bases used to calculate CSI.

FIG. 5

Example CSI using Hot tone RMS and Alpha as basis.

| | Can order based on Hot tone | Hot tone RMS value | Deviation from mean hot tone RMS (46) | Normalized CSI based on Hot tone RMS (46) | Can order based on alpha | Alpha | Deviation from mean alpha (46) | Normalized CSI based on alpha (46) |
|---|---|---|---|---|---|---|---|---|
| Coldest | 14 | 0.25 | -0.81 | -1.00 | 7 | 3.78 | 2.42 | -1.00 |
| | 13 | 0.26 | -0.80 | -0.99 | 13 | 2.60 | 1.24 | -0.23 |
| | 7 | 0.28 | -0.78 | -0.96 | 14 | 2.06 | 0.70 | 0.12 |
| | 6 | 0.43 | -0.63 | -0.78 | 1 | 1.54 | 0.18 | 0.46 |
| | 12 | 0.87 | -0.19 | -0.24 | 6 | 1.31 | -0.05 | 0.61 |
| | 4 | 0.99 | -0.07 | -0.09 | 4 | 1.06 | -0.30 | 0.77 |
| | 11 | 1.21 | 0.15 | 0.18 | 3 | 1.02 | -0.34 | 0.80 |
| | 1 | 1.26 | 0.20 | 0.24 | 2 | 0.91 | -0.45 | 0.87 |
| | 3 | 1.29 | 0.23 | 0.28 | 11 | 0.90 | -0.46 | 0.88 |
| | 2 | 1.30 | 0.24 | 0.29 | 5 | 0.89 | -0.47 | 0.88 |
| | 10 | 1.50 | 0.44 | 0.53 | 10 | 0.79 | -0.57 | 0.95 |
| | 5 | 1.63 | 0.57 | 0.69 | 9 | 0.75 | -0.61 | 0.98 |
| | 8 | 1.68 | 0.62 | 0.75 | 12 | 0.72 | -0.64 | 0.99 |
| Hottest | 9 | 1.88 | 0.82 | 1.00 | 8 | 0.71 | -0.65 | 1.00 |
| | mean hot tone RMS | 1.06 | | | Mean Alpha | 1.36 | | |

Non-normalized Alpha based CSI Polar Plots for 14 cans.

Non-normalized Hot tone based CSI Polar Plot for 14 cans.

Exemplary Multiple can combustion fuel supply system

CSI driven can-to-can variation tuning

METHOD OF TUNING INDIVIDUAL COMBUSTION CHAMBERS IN A TURBINE BASED ON A COMBUSTION CHAMBER STRATIFICATION INDEX

BACKGROUND OF THE INVENTION

Gas turbines, used in power plants for example, typically have multiple combustion chambers. The combustion chambers are termed "cans" in the art. The cans have variation in fuel flow and air flow due to variation in an associated fuel and air distribution system. Consequently, this variation manifests itself in terms of fuel to air ratio variation, which leads to variation in temperature, dynamics (pressure vibration) and emissions across the combustion chambers or cans. The can to can variation or stratification also contributes to turbine exhaust temperature variation. Another important factor that contributes to exhaust temperature variation is variation in circumferential and axial expansion (that determines temperature and pressure gradients) over the turbine stages due to flow variation and geometry.

The can to can variation in terms of fuel to air ratio leads to some cans being hotter, i.e. higher flame (or firing) temperature than others due to higher fuel to air ratio than other cans. These cans exhibit higher Nitrogen Oxides (NOx) emissions and certain pressure dynamic spectral tones (to be defined later in this patent) corresponding to higher flame temperature tend to be stronger. On the other hand, this variation can lead to one can burning very lean or almost "blowing out" (i.e., flame extinguishes), if for example, the fuel to air ratio is below a certain threshold The blowout of a combustion chamber or a can is termed "Lean Blow out" or LBO. Colder cans have higher LBO risk and higher Carbon Monoxide (CO) emissions due to leaner fuel to air ratio than hotter cans that have higher NOx emissions due to higher fuel to air ratio. Colder cans also have certain dynamic tones that respond to colder firing temperature, i.e., tones that increase in amplitude as firing temperature decreases. If it were possible to monitor firing temperature of each can, it would help to balance the cans by changing fuel or airflow to the can. However, due to the extreme temperatures and operating conditions within the cans, temperatures sensors cannot be currently located in each can to monitor the temperatures within each can as the present temperature sensing technology cannot withstand such harsh conditions. Instead, in the art, pressure dynamics are measured for combustion chambers or cans and are used as an indicator of "hotness" or "coldness" of a can. There are certain dynamic tones (as will be explained later) that can be used to estimate the firing temperature of the can. Using pressure vibration sensors, feedback for each can, fuel flow and airflow is scheduled at the global or turbine level (total air and fuel for all the cans) to meet turbine load requirements such that the combustion dynamics in each can and emissions at the turbine level are within acceptable limits. If emissions be measured at the can level, then the objective would be to achieve emissions compliance at the can level. Specifically, according to current combustion tuning practice, the overall fuel splits from the fuel system to the cans and the bulk fuel flow are set through the main fuel gas control valves.

Tuning of a multiple-chamber combustion system is driven by the following constraints: 1) maintaining the gas turbine unit emissions below a set target across a pre-defined load range and 2) maintaining the individual can combustor dynamics below acceptable limits across the load range. Accordingly, the tuning process attempts to set the configuration of the main gas control valves such that the worst can has combustor dynamics below an acceptable limit. In this process, the overall operability window is set by the combustion response of either the "richest" (highest fuel to air ratio (f/a)) can or the "leanest" (lowest fuel to air ratio (f/a)) can. The variation in the response of the individual combustion chambers is hereafter referred to as "can-to-can" variation. In order to address this can level variation, trim devices such as but not limited to valves, orifice plates, etc. that can control flow to individual cans are needed. This helps increase the operability window by making all the cans fire uniformly. This ensures uniform degradation of hardware making maintenance easy. Any reduction in can to can variation provides an uprate opportunity in terms of firing temperature and hence power output subject to hardware (temperature limits) and emissions constraints. This in other words implies more output with acceptable emissions.

Additionally, exhaust gas temperatures have been examined in methods like that shown in U.S. Patent Application US 2002/01 83916 A1 to identify malfunctioning combustion chambers. In said application, is noted that typically in the art, a turbine must be shut down and examined to determine which cans are malfunctioning. Therefore, to avoid this loss of time and expense, a system that can monitor the cans while the turbine is operating is desirable so as to enable online tuning of fuel to air (f/a) ratio of the cans to reduce can to can variation in terms of dynamics, reduce emissions and provide an opportunity of increased output subject to emissions and hardware life constraints.

Thus, a method for determining and dealing with can-to-can variations and addressing it by tuning f/a ratio is needed to ensure uniform life of the cans and to provide more efficient operation of the turbine with opportunity for increased output and reduced emissions.

BRIEF DESCRIPTION OF THE INVENTION

A method, system and software for reducing combustion chamber to chamber variation in a multiple-combustion chamber turbine system comprising sensing dynamic combustion pressure tones emitted from combustion chambers in a multiple combustion chamber turbine and determining a combustion chamber stratification index for the combustion chambers using the dynamic combustion pressure tones emitted for the combustion chambers to record and/or tune combustion chamber performance variations in the multiple-chamber combustion turbine system.

BRIEF DESCRIPTION OF THE DRAWINGS

The following descriptions of various possible embodiments are not intended to be, and should not be considered to be, limiting in any way.

FIG. 5 is an exemplary table of CSI values based on hot tone and RMS ratio ($\alpha$) as the basis.

DETAILED DESCRIPTION OF THE INVENTION

Figure 1:
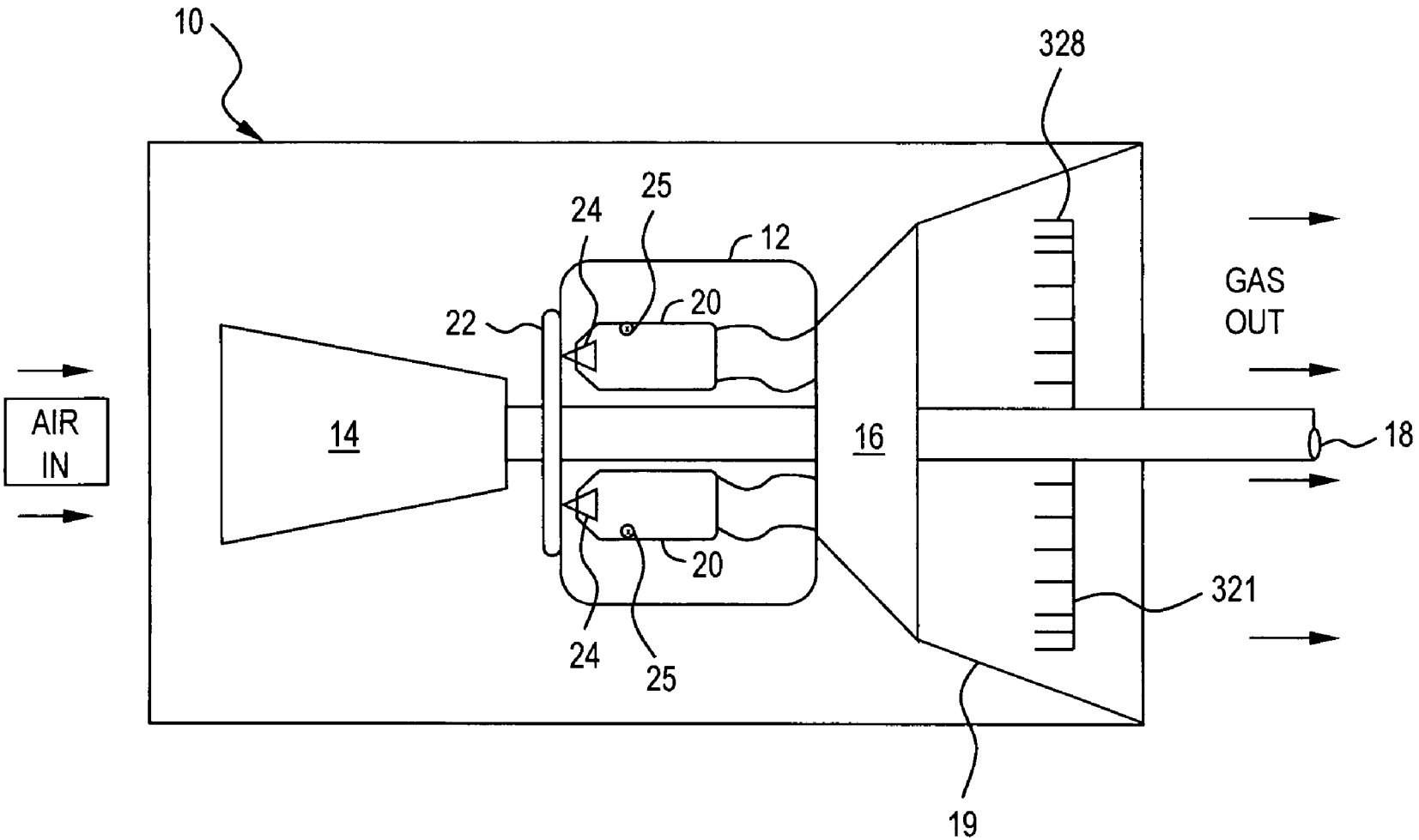
FIG. 1 is a diagram of a gas turbine having combustion cans.

An example of a gas turbine is shown in FIG. 1. However, the present invention may be used with many different types of turbines, and thus the turbine shown in FIG. 1 should not be considered limiting to this disclosure.

As shown in FIG. 1, a gas turbine 10 may have a combustion section 12 located in a gas flow path between a compressor 14 and a turbine 16. The combustion section 12 may include an annular array of combustion chambers known herein as combustion cans 20. The turbine 10 is coupled to rotationally drive the compressor 14 and a power output drive shaft 18. Air enters the gas turbine 10 and passes through the compressor 14. High pressure air from the compressor 14 enters the combustion section 12 where it is mixed with fuel and burned. High energy combustion gases exit the combustion section 12 to power the turbine 10, which, in turn, drives the compressor and the output power shaft 18. The combustion gases exit the turbine 16 through the exhaust duct 19, which may include a heat recapture section to apply exhaust heat to preheat the inlet air to the compressor.

Fuel is injected via the nozzles 24 into each chamber and mixes with compressed air flowing from the compressor. A combustion reaction of compressed air and fuel occurs in each chamber. A more detailed description of the fuel system is described in below in reference to FIG. 8.

A conventional technique for diagnosing combustion problems in a gas turbine is to shut down the gas turbine and physically inspect all of the combustion chambers. This inspection process is tedious and time-consuming. It requires that each of the combustion chambers be opened for inspection. While this technique is effective in identifying problem combustion chambers, it is expensive in terms of lost power generation and of expensive repair costs. The power generation loss due to an unscheduled shut down of a gas turbine, especially those used in power generation utilities, is also costly and is to be avoided if at all possible. In addition, gas turbine shut-downs for combustion problems are generally lengthy because the problem is diagnosed after the gas turbine is shut down, cooled to a safe temperature and all chambers are inspected. Accordingly, combustion problems can force gas turbines to shut down for lengthy repairs.

Figure 2:
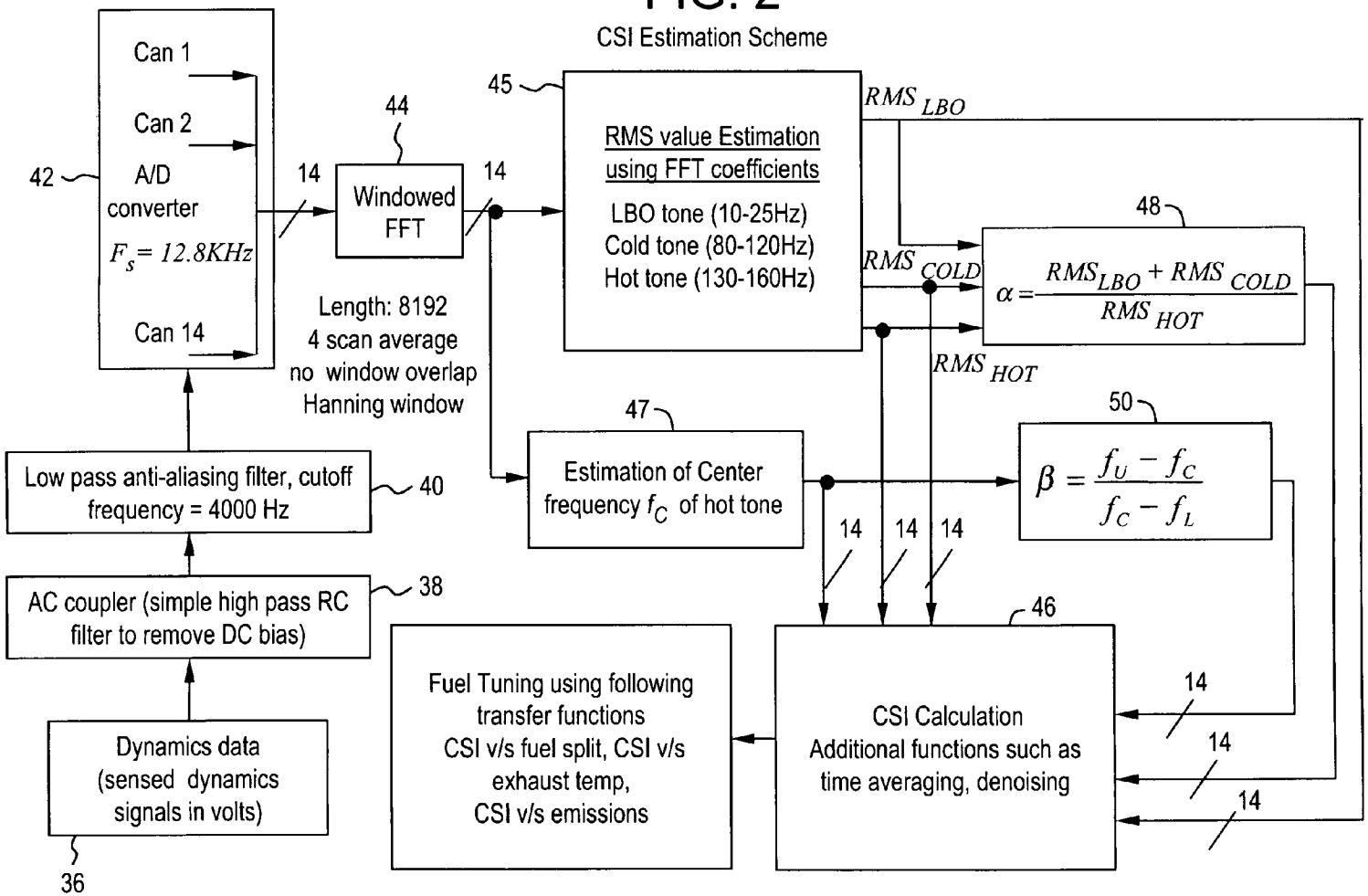
FIG. 2 is a schematic diagram of an embodiment showing a Can Stratification Index (CSI) estimation scheme.

Thus, there is a need for measurement of combustion dynamics of each can during operation. Thus, in this embodiment, pressure probes 25 are located in each can 20. A signal processor (not shown) converts the dynamic pressure vibrations in each can 20 into voltages to create combustion dynamics signals or "tones" which are used herein. Three dynamic combustion tones in particular are used frequently in this embodiment, namely, the hot tone 30, cold tone 32, and LBO (Lean Blow Out) tone 34. These tones, namely, LBO, cold and hot tone may be referred to by other names such as peak 1, peak 2 and peak 3 in practice. The names used in this invention were selected for ease of understanding so that each tone gets a name that indicates the impact of the f/a ratio on it and so that the name captures the significance of the tone, for instance, LBO tone is associated with incipient blowout conditions. As shown in FIG. 2, the Hot Tone 30, in this embodiment, is between 130-160 Hertz. The Cold Tone 32 in this embodiment is between 80-120 Hertz. The LBO Tone 34 in this embodiment is between 10-25 Hertz. As mentioned earlier, the LBO tone is so named because any amplitude increment of the tone may indicate blowout conditions. In other words, a significant LBO tone may indicate that the particular can's f/a ratio is low enough to cause a blowout. The cold tone is the frequency (or frequency range) whose amplitude tends to increase as the temperature of the can decreases. At the same time, the hot tone is the frequency (or frequency range) whose amplitude tends to increase as the temperature of the can increases. The frequency range for the tones are relative, i.e., "hot or cold" and depend upon the specific turbine. Therefore, the ranges stated above are exemplary only and are not limiting regarding other turbines. Depending upon the type of combustor and turbine, the number of tones of significance for tuning may vary. In this invention, a specific type of multiple can combustor is considered as an example.

Using these tones and algorithms described below, the present embodiment is able to identify the can to can variation in terms of combustion dynamic pressures including the "hottest" can and/or the "coldest" can. It is also possible to quantify the variation of an individual can and to tune an individual combustion chamber such that the overall can-to-can variation in the system is reduced. Thus, the present embodiment may facilitate tuning the individual combustion chambers of a gas turbine in order to reduce the can-to-can variation in f/a ratio, which in turn implies reducing variation in terms of firing temperature, dynamics and emissions. The present embodiment involves establishing a "Can Stratification Index (CSI)" which is based on the spectral tones of the cans and correlated to the f/a ratio of the can. The CSI metric indicates the can to can variation, that is, it points out outlier hot and cold cans and also helps to tune the fuel or airflow of the cans in order to reduce the can to can variation. This reduction in terms is also captured in terms of CSI of each can. CSI correlation with emissions and firing temperature of each can captures the effect of variation reduction in can level emissions and firing temperature.

Figure 3:
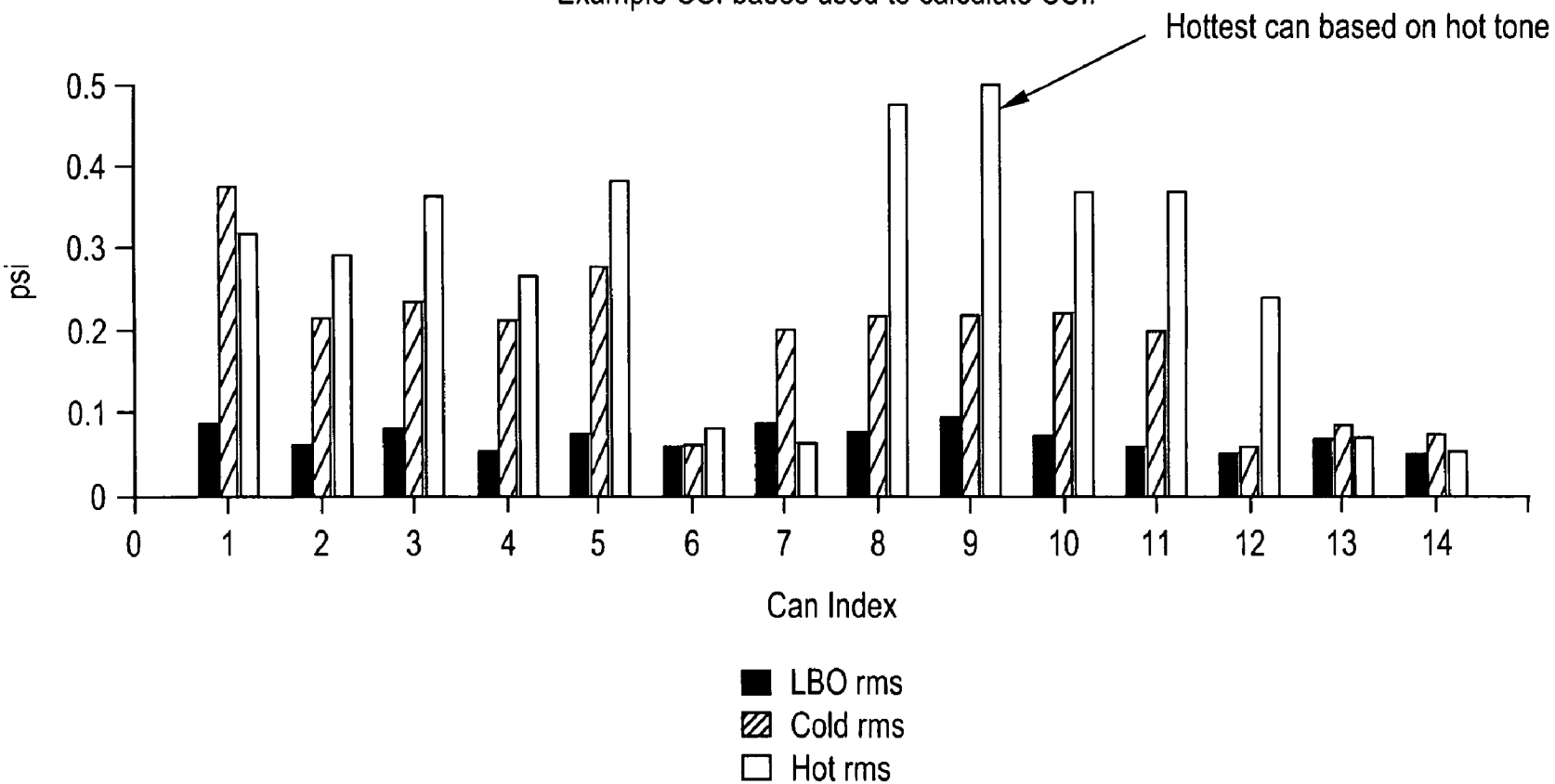
FIG. 3 is bar graph of example CSI bases that can be used to calculate CSI.

An embodiment of a method in accordance with the invention is shown in FIG. 2, and may use a Can Stratification Index or "CSI" 46 algorithm described further below that involves use of (i) relative change of the Root Mean Square (RMS) values of different dynamic combustion pressure tones such as Hot Tones 30 and Cold Tones 32 (from each can 20) along with the LBO Tones 34 of each can (known as RMS ratio $\alpha$ 48) and/or (ii) frequency shift of one of the tones as evidential information (known as beta $\beta$ 50), to establish Can Stratification Indices (CSI 46). The gas turbine treated as an example here, has 14 cans and exhibits three tones, the LBO Tone 34 (10-25 Hz), Cold Tone 32 (80-120 Hz) and the Hot Tone 30 (130-160 Hz). The logic shown in FIG. 2 comprises three main parts: I. RMS signal extraction of different tones 45, II. frequency tracking of the Hot Tone 30 and III. Can Stratification Index (CSI 46) estimation using different bases. As shown in the schematic in FIG. 2, the dynamic combustion data 36 for each can is presented as a voltage signal after being converted from dynamic combustion pressure vibrations in a signal processor (not shown) of the pressure probes 25. At 38, if the signals have DC bias, a high pass RC filter is used to remove the DC bias. Next, at 40, a low pass anti-aliasing filter with a cutoff frequency of 4000 Hz may be used. At 42, the dynamics signals from the cans 20 are sampled at high frequency, (12.8 KHz) by an analog to digital (A/D) converter 42. At 44, a windowed Fast Fourier Transform (FFT) is performed (FFT length=8192, single scan, no overlap and Hanning window) and is then used to get the frequency spectrum of the AC coupled dynamics (acoustic) signal. It also possible in alternative embodiment to not use the windowed Fast Fourier Transform (FFT) and instead use a Bandpass filter. As described below with reference to the formulas, at 45 in a RMS value estimator, the summation of such single scan FFT coefficients in the frequency bands of the three tones with a scaling parameter is used to estimate the Root Mean Square (RMS) values of the respective tones.

$$RMS_{COLD} = K \cdot \sqrt{\sum_{j=1}^{n_{COLD}} fft.coef_{COLD}(j)^2},$$

$$RMS_{HOT} = K \cdot \sqrt{\sum_{j=1}^{n_{HOT}} fft.coef_{HOT}(j)^2}$$

$$RMS_{LBO} = K \cdot \sqrt{\sum_{j=1}^{n_{LBO}} fft.coef_{LBO}(j)^2}$$

where $n_{COLD}n_{HOT}$, and $n_{LBO}$ are the number of frequency bins in the Cold Tone 32, Hot Tone 30 and LBO tone 34, and the $fft.coef_{COLD}$,$fft.coef_{HOT}$,$fftcoef_{LBO}$ are the FFT coefficients of the frequencies within the cold, hot and the LBO tone. The gain K depends on the type and length of FFT window used and is designed using Parseval's theorem that is commonly used to estimate RMS values using FFT coefficients. Refer to FIG. 3 for a time averaged snapshot of the three RMS tones for a specific turbine operation. These tones can be used as basis for CSI definition. The RMS ratio, a 48, which reflects the relative change in three tones is defined as:

$$\alpha = \frac{RMS_{LBO} + RMS_{COLD}}{RMS_{HOT}}.$$

The frequency of the Hot Tone 30 is tracked using a fine bin resolution. At a given sampling frequency, increasing the FFT length improves the bin resolution. At 12.8 KHz, a FFT window of 8192 samples gives a resolution of 1.56 Hz. This bin resolution dictates the number of bins within each band. As shown at 47 in FIG. 2, the instantaneous center frequency, $f_c$, of the Hot Tone 30 may be tracked in the following way:

$$f_C = \frac{\sum_{j=1}^{n_{HOT}} Freq_{HOT}(j) * fft.coef_{HOT}^2}{\sum_{j=1}^{n_{HOT}} fft.coef_{HOT}^2}$$

where $Freq_{HOT}(j)$ contains the $n_{Hot}$ Hot Tone 30 frequencies. Thus, $f_c$ is a weighted average of the frequencies within the Hot Tone 30 (1.56 Hz resolution). The weights are the squares of the respective FFT coefficients. The RMS values as well as the Hot Tone 30 center frequency $f_c$ may then be low pass filtered to reduce noise by using moving average filters (MAF) that use four scans to form an average.

Figure 4:
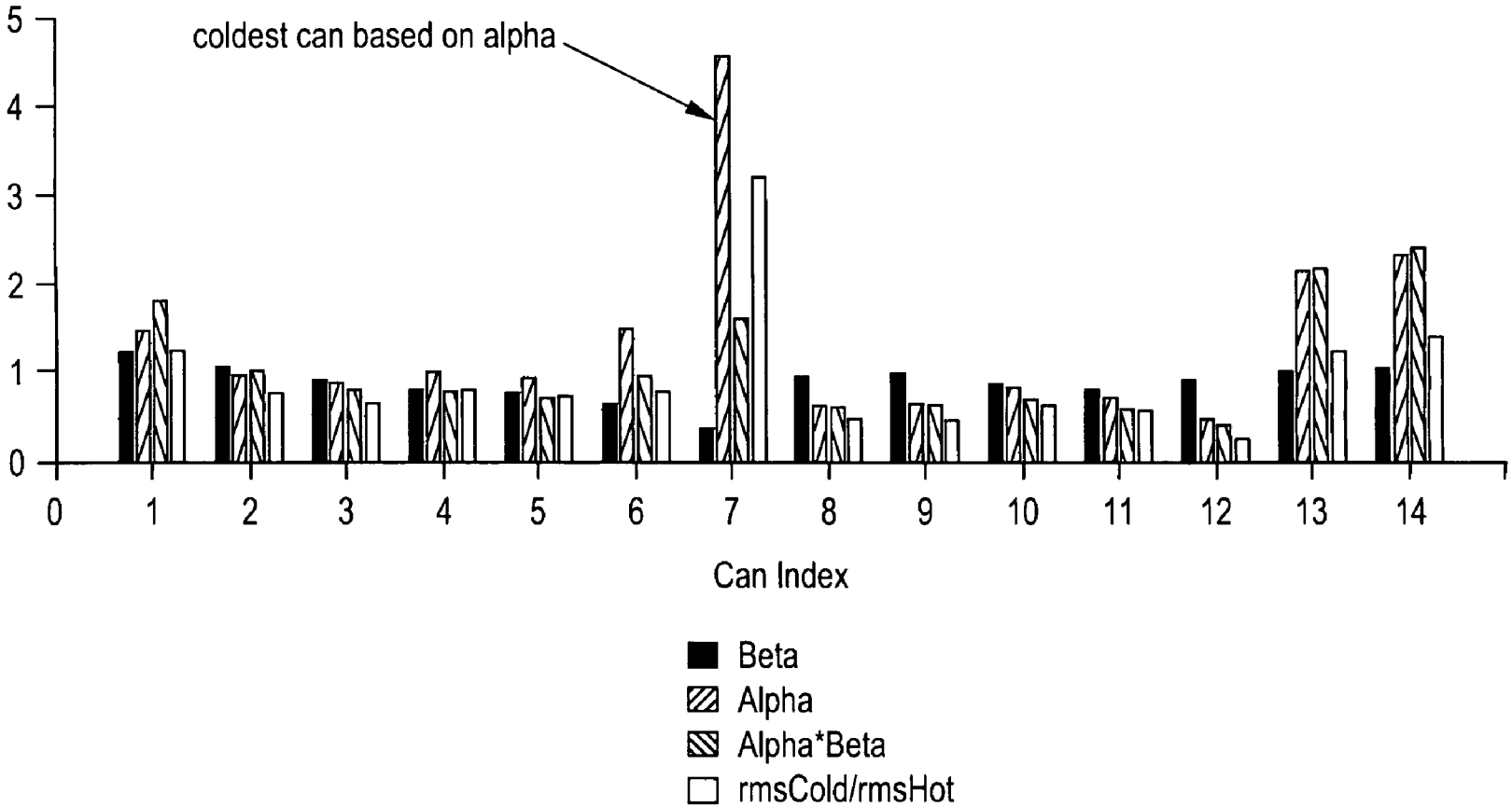
FIG. 4 is bar graph of example CSI bases that can be used to calculate CSI.

Now that all the desired pieces of information from the spectral processing of dynamics data are determined, different bases or criteria for creation of the Can Stratification Index (CSI 46) can be set up. One basis may simply be the RMS values of the tones, $RMS_{LBO}$ tone, $RMS_{COLD}$ tone and/or the $RMS_{HOT}$ tone as shown in FIG. 3. Other bases that were established after analyzing typical baseload operation and some LBO turbine trips (part load or baseload) are RMS ratio α 48 and Hot Tone 30 frequency shifting β 50. Refer to FIG. 4 for different bases such as α, β, α.β and the ratio of cold RMS tone to hot RMS tone that can be used to define CSI 46. All the bases chosen indicate the temperature of the can, and when correlated with fuel flow changes, provide a means to tune the fuel flow of the can in order to reduce temperature which in turn implies reduction of NOx emissions and certain dynamic tones.

Thus, in general the Can Stratification Index (CSI) 46 is defined as the deviation from the average basis for all the cans. The basis for CSI 46 could be the three different RMS tones, the corresponding frequencies or the relative distribution of energy among the three tones as mentioned above. Hot tone 30 based CSI 46 of negative value indicates that the can is colder than the average level and positive value CSI 46 indicates a hotter can at that time instant. The outlier can has a larger CSI 46 magnitude whatever it is hot or cold. The value of CSI 46 basis as the individual RMS tones, RMS ratio 48 and frequency shifting at a given time instant indicate stratification in terms of corresponding CSI 46 basis or criteria. If the CSI 46 is based on RMS ratio α 48, because the way α 48 is defined, a negative value actually indicates a hotter can and positive value indicates a colder can. In order, to be consistent, it's recommended to invert the sign.

In order to point out outlier cans 52 easily, CSI 46 values can then be normalized between −1 and 1. However, for analytical purpose, non-normalized CSI 46 is useful to correlate percent (%) fuel variation across all the cans and the unswirled exhaust temperatures (The exhaust from each can gets a swirl as it expands over the turbine blades. Hence, the exhaust temperatures sensed by circumferentially located temperature sensors, typically thermocouples, need to unswirled back so that they correlate to the correct combustion chamber). This then facilitates can level or global level fuel flow manipulations to balance the cans in terms of dynamics and reduce dynamics and exhaust temperature spreads subject to emissions. When normalized, CSI 46 of −1 indicates that the can is the coldest in terms of the basis and the definition used in this embodiment and +1 indicates the hottest can at that time instant in terms of the basis used. For example, normalized value of CSI 46 based on α and the individual RMS tones at a given time instant indicate where this normalized stratification is located in terms of absolute dynamics value in psi. Using the basis for CSI 46 as RMS ratio α 48, we have at time instant t(say, in seconds):

Average of CSI 46 criteria or basis at time instant t.

$$\alpha_{avg}(t)=\mathrm{Avg}(\alpha_i(t), \ldots, \alpha_N(t))$$

where Avg indicates the averaging operation.

Deviation from average CSI 46 basis for a can at time instant t is the non-normalized CSI 54 below:

$$CSI_{\alpha i}(t)=\Delta_{\alpha i}(t)=\alpha_i(t)-\alpha_{avg}(t)$$

This deviation (non-normalized) or the raw values of α drive the can level tuning in a quantified manner, i.e., quantified can level bulk fuel flow or splits variations. The normalization helps qualitative analysis.

Max and Min deviation across all N cans at time instant t can be given as below:

$$\Delta_{\alpha MAX}(t)=\mathrm{MAX}(\Delta_{\alpha i}(t), \ldots, \Delta_{\alpha N}(t)), \Delta_{\alpha MIN}(t)=\mathrm{MIN}(\Delta_{\alpha i}(t), \ldots, \Delta_{\alpha N}(t))$$

CSI normalized between −1 and 1:

$$NCSI_{\alpha i}(t) = -\left(2 * \left[\frac{\Delta_{\alpha i}(t) - \Delta_{\alpha \mathrm{MIN}}(t)}{\Delta_{\alpha \mathrm{MAX}}(t) - \Delta_{\alpha \mathrm{MIN}}(t)}\right] - 1\right).$$

The vector NCSI (t) indicates the defined stratification of the cans at time instant t. Note that, since the basis is RMS ratio 48, we need to invert the sign when normalizing between −1 to +1.

Similarly, different basis can be selected as follows, and the corresponding mathematically formulation is given. This is not meant to be exhaustive list of all possible bases that are encompassed by the invention, but merely illustrate various examples.

Basis—Hot Tone 30 RMS $$RMS_{HOT_{avg}}(t) = Avg(RMS_{HOT_i}(t), \cdots, RMS_{HOT_N}(t))$$

$$CSI_{HOT_i}(t) = \Delta_{HOT_i}(t) = RMS_{HOT_i}(t) - RMS_{HOT_{avg}}(t)$$

$$\Delta_{HOT_{\mathrm{MAX}}}(t) = \mathrm{MAX}(\Delta_{HOT_i}(t), \cdots, \Delta_{HOT_N}(t))$$

$$\Delta_{HOT_{\mathrm{MIN}}}(t) = \mathrm{MIN}(\Delta_{HOT_i}(t), \cdots, \Delta_{HOT_N}(t))$$

$$NCSI_{HOTi}(t) = 2 * \left[\frac{\Delta_{HOT_i}(t) - \Delta_{HOT_{\mathrm{MIN}}}(t)}{\Delta_{HOT_{\mathrm{MAX}}}(t) - \Delta_{HOT_{\mathrm{MIN}}}(t)}\right] - 1$$

Note that, we do not need to invert the sign while normalizing.

Basis—LBO Tone 34 RMS $$RMS_{LBO_{avg}}(t) = Avg(RMS_{LBO_i}(t), \cdots, RMS_{LBO_N}(t))$$

$$CSI_{LBO_i(t)} = \Delta_{LBO_i}(t) = RMS_{LBO_i}(t) - RMS_{LBO_{avg}}(t)$$

$$\Delta_{LBO_{\mathrm{MAX}}}(t) = \mathrm{MAX}(\Delta_{LBO_i}(t), \ldots, \Delta_{LBO_N}(t))$$

$$\Delta_{LBO_{\mathrm{MIN}}}(t) = \mathrm{MIN}(\Delta_{LBO_i}(t), \ldots, \Delta_{LBO_N}(t))$$

$$NCSI_{LBO_i}(t) = 1 - 2 * \left[\frac{\Delta_{LBO_i}(t) - \Delta_{LBO_{\mathrm{MIN}}}(t)}{\Delta_{LBO_{\mathrm{MAX}}}(t) - \Delta_{LBO_{\mathrm{MIN}}}(t)}\right]$$

Note that, we need to invert the sign while normalizing.

Basis—Cold Tone 32 RMS $$RMS_{COLD_{avg}}(t)Avg(RMS_{COLD_i}(t), \ldots, RMS_{COLD_N}(t))$$

$$CSI_{LBO_i}(t) = \Delta_{COLD_i}(t) = RMS_{COLD_i}(t) - RMS_{COLD_{avg}}(t)$$

$$\Delta_{COLD_{\mathrm{MAX}}}(t) = \mathrm{MAX}(\Delta_{COLD_i}(t), \ldots, \Delta_{COLD_N}(t))$$

$$\Delta_{COLD_{\mathrm{MIN}}}(t) = \mathrm{MIN}(\Delta_{COLD_i}(t), \ldots, \Delta_{COLD_N}(t))$$

$$NCSI_{COLD_i}(t) = 1 - 2 * \left[\frac{\Delta_{COLD_i}(t) - \Delta_{COLD_{\mathrm{MIN}}}(t)}{\Delta_{COLD_{\mathrm{MAX}}}(t) - \Delta_{COLD_{\mathrm{MIN}}}(t)}\right]$$

Note that, we need to invert the sign while normalizing.

Basis—Temperature tone frequency: Some of the combustors used in this embodiment exhibit a transverse acoustic tone in a higher frequency range. The location of the frequency of this tone is dependent upon the temperature of the can. A physics based relation has been established that uses the dimension of the can and the frequency of the transverse acoustic tone to correlate to speed of sound (dynamics), which in turn depends upon the temperature of the can. Hence, the firing temperature of the combustor chamber can be estimated. According to the relation, the higher the transverse acoustic tone frequency (temperature tone frequency) Trans_freq, the higher the temperature of the can. CSI based upon this physics based relationship can be given as follows.

$$\mathrm{Trans_freq}_{avg}(t) = Avg(\mathrm{Trans_freq}_i(t), \ldots, \mathrm{Trans_freq}_N(t))$$

$$CSI_{\mathrm{Trans_freq}_i}(t) = \Delta_{\mathrm{Trans_freq}_i}(t) = \mathrm{Trans_freq}_i(t) - \mathrm{Trans_freq}_{avg}(t)$$

$$\Delta_{\mathrm{Trans_freq}_{\mathrm{MAX}}}(t) = \mathrm{MAX}(\Delta_{\mathrm{Trans_freq}_i}(t), \ldots, \Delta_{\mathrm{Trans_freq}_N}(t))$$

$$\Delta_{\mathrm{Trans_freq}_{\mathrm{MIN}}}(t) = \mathrm{MIN}(\Delta_{\mathrm{Trans_freq}_i}(t), \ldots, \Delta_{\mathrm{Trans_freq}_N}(t))$$

$$NCSI_{\mathrm{Trans_freq}_i}(t) = 2 * \left[\frac{\Delta_{\mathrm{Trans_freq}_i}(t) - \Delta_{\mathrm{Trans_freq}_{\mathrm{MIN}}}(t)}{\Delta_{\mathrm{Trans_freq}_{\mathrm{MAX}}}(t) - \Delta_{\mathrm{Trans_freq}_{\mathrm{MIN}}}(t)}\right] - 1$$

Note that, we do not need to invert the sign while normalizing. CSI based on this basis is useful to track how the cans behave in LBO prone transient turbine operations. Also, this estimated firing temperature based stratification could be translated into stratification in terms of combustor life. This is achieved by translating the estimated firing temperature into a can (hardware) "maintenance factor" that indicates the rate of usage of its hardware life. Higher the firing temperature, greater is the rate of usage of life. The stratification tells which cans' life is getting consumed at a faster rate and which cans are not getting beaten as much. This information can be then used to direct fuel tuning such that the life of all cans gets consumed more evenly, in other words, reduce the variation of estimated firing temperature based CSI. At the same time, while going after emissions or dynamics variation reduction as an objective, the life impact captured by stratification based on combustor hardware maintenance factor can be treated as a constraint.

Figure 7:
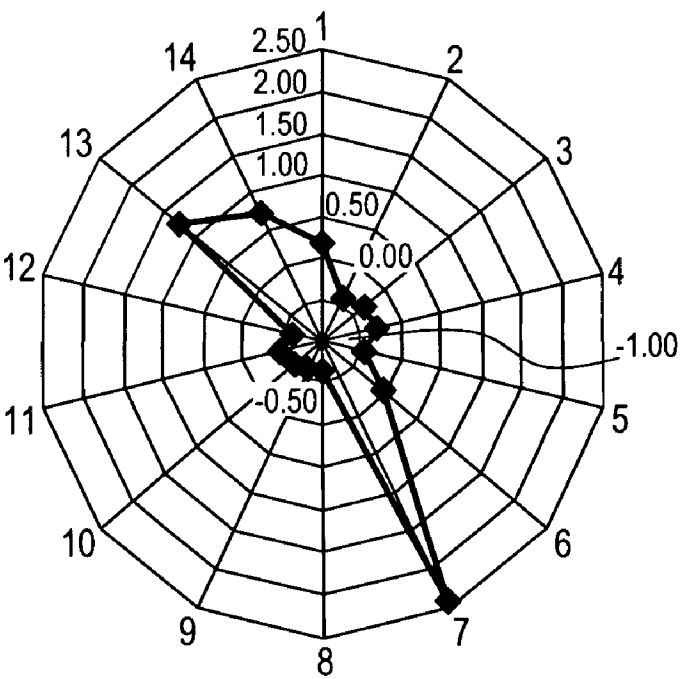
FIG. 7 is non-normalized RMS ratio ($\alpha$) based CSI Polar Plot for 14 cans.
Figure 6:
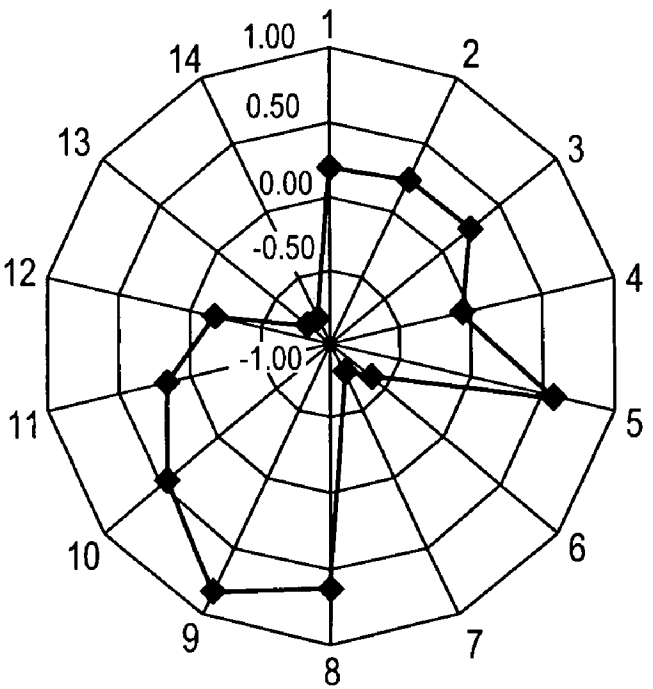
FIG. 6 is non-normalized Hot tone based CSI Polar Plot for 14 cans.

In the illustrative example shown in FIG. 5, CSI 46 is defined using Hot Tone 30 RMS value and RMS ratio α (Alpha) as the basis for a certain steady state turbine operation. The reference numerals 46 which show CSI 46 from different basis or criterion. Using the values in the table of FIG. 5, the non-normalized CSI values are plotted in a radar or polar plot in FIG. 6 with Hot Tone 30 RMS as the basis and FIG. 7 with RMS ratio 48 α (Alpha) as the basis.

In addition to the bases used above, CSI 46 can be based on a Beta factor β 50. As shown in FIG. 2, β 50 may equal for example, $\beta=(f_u-f_c)/(f_c-f_l)$ where $f_c$ is the estimated center frequency of Hot Tone 30 and $f_u$ and $f_c$ are constants. $f_u$ the upper band of the Hot Tone 30 frequency and $f_c$ is a constant, for example 130 Hz. It has been observed that β 50 increases as the can becomes colder. Any additive or multiplicative combination of such bases can also be used if doing so, one may obtain better correlation to the fuel flow. There are different options suggested for tracking CSI 46 depending upon the operational mode of the turbine. For example, it may be desired to track changes in CSI 46 over an event, for instance, a step change in fuel flow to one or more cans. On the other hand, it may be sufficient to get an instantaneous snap shot or time averaged snap shot of the relative can to can dynamics distribution in terms of CSI when the turbine is at steady state in some operational mode such as base load. In this case, there is no need to track CSI 46 variation over time to indicate the effect on dynamics of an operational or experimental change.

Figure 8:
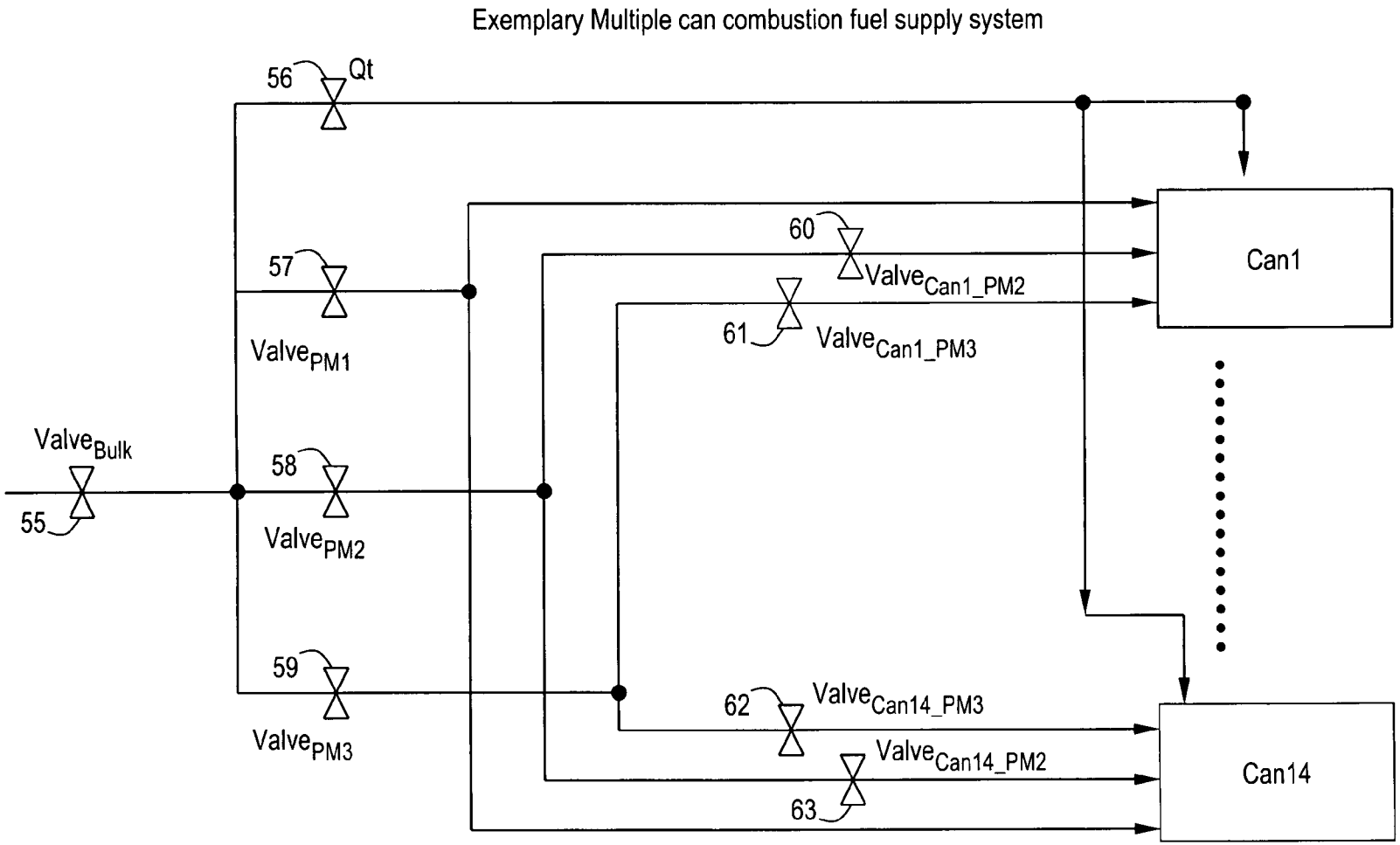
FIG. 8 is a diagram of an exemplary multiple can combustor fuel supply system.

As the cans 20 will be tuned by tuning the fuel to the cans 20 based upon CSI, now is an appropriate time to discuss the exemplary multiple can combustion fuel system and the valves, which control the fuel flow to the cans 20 as shown in FIG. 8. Normally, a gas turbine just has global manifold valves that supply fuel to all the cans. In one particular system considered here, there are four manifolds. In FIG. 8, a bulk valve 55 is the main valve. Next a series of four global manifold valves feed each can, Qt 56 valve, which is called Quaternary valve, PM1 valve 57, PM2 valve 58, and PM3 valve 59. The prefix "PM" stands for pre-mixed. The way the turbine level bulk fuel flow is split into these four manifold fuel flows depends upon what mode of operation the turbine is in (example: base load versus partload). The PM1, PM2 and PM3 manifold each supply fuel to certain nozzles of each combustion chamber. Additionally, any desired number of flow trim valves or devices (60-63) may also be included. In this embodiment each can 20 has a flow trim valve or device such as an orifice plate associated with the can which is located downstream of the PM2 valve 58 and the PM3 59 valve. By controlling some or all of these valves and the fuel "splits" the fuel flow to the cans can be tuned. In this embodiment, the use of a valve and/or an "orifice" plate is stressed for trimming can level fuel flow.

As mentioned above, in order to extend the capability of tuning one specific combustion chamber, the present embodiment may use sets of additionally tuning valves (60-63) that are installed in the downstream of each pigtail or pipe of PM2 and PM3 manifold and before the entry of each can. Specifically, in FIG. 8, Canl PM2 tuning valve 60, Can1 PM3 tuning valve 61, Can 14 PM3 Tuning Valve 62 and Canl 4 PM2 tuning valve 63 are shown but more tuning valves exist (not shown) for all the cans, i.e. 1-14. Any number of tuning valves may be used depending upon the number of cans 20 in the specific turbine and the cost/geometry constraints. With these additional fuel flow trim devices (60-63), a user can flexibly trim the total fuel flow as well as the fuel split between different nozzles to each can.

$$I^{th}\ \text{Can's bulk fuel flow} =$$

$$Bulk_{cani} = PM1_{cani} + PM2_{cani} + PM3_{cani} + QT_{cani}$$

$$I^{th}\ \text{Can's } PM3 \text{ split of can} = \%PM3_{cani} = \frac{PM3_{cani}}{PM2_{cani} + PM3_{cani}} \times 100\%$$

$$I^{th}\ \text{Can's } PM2 \text{ split} = \%PM2_{cani} = 100 - PM3\%_{cani}$$

If it is assumed that the manifold fuel flow of PM1 valve 57 and QT valve 56 are evenly distributed to each can, they can be ignored when considering the contribution of can-to-can variation reduction. The $i^{th}$ can's total fuel flow $Bulk_{cani}$ can be re-written as:

$$I^{th}\ \text{Can's bulk fuel flow} = Bulk_{cani} = PM2_{cani} + PM3_{cani}$$

$$I^{th}\ \text{Can's } PM3 \text{ split} = \%PM3_{cani} = \frac{PM3_{cani}}{PM2_{cani} + PM3_{cani}} \times 100\%$$

$$I^{th}\ \text{Can's } PM2 \text{ split} = \%PM2_{cani} = 100 - PM3\%_{cani}$$

Now it is appropriate to discuss a method for identification of Outlier Cans 52 through a diagnostic global (turbine level) fuel split scan. The use of a diagnostic fuel split scan of the unit can be used to identify the underlying can-to-can variation in the system by stimulating the can dynamics and separating the outlier cans in terms of dynamics. For example, a global PM3 or global PM1 fuel split scan is used. In this methodology, the user slowly ramps up the fuel split from the current operating schedule ("reference") to a slightly higher level ("bias") such that the overall combustor dynamics (for example, can be defined as maximum value of hot tone 30 across all the cans) is less than some pre-set limit. The turbine remains at the biased split schedule for a set time to allow for the dynamics to stabilize and thereafter, it is ramped down to a previous operating fuel split schedule. Simultaneously, the CSI 46 index using an appropriate basis is computed based on the individual combustor dynamic tones at the reference fuel split schedule and at the biased split schedule. The global PM3 ramp up stimulates all the cans by making them hotter and can be interpreted as a magnifying lens in order to assess the can to can stratification.

Figure 9:
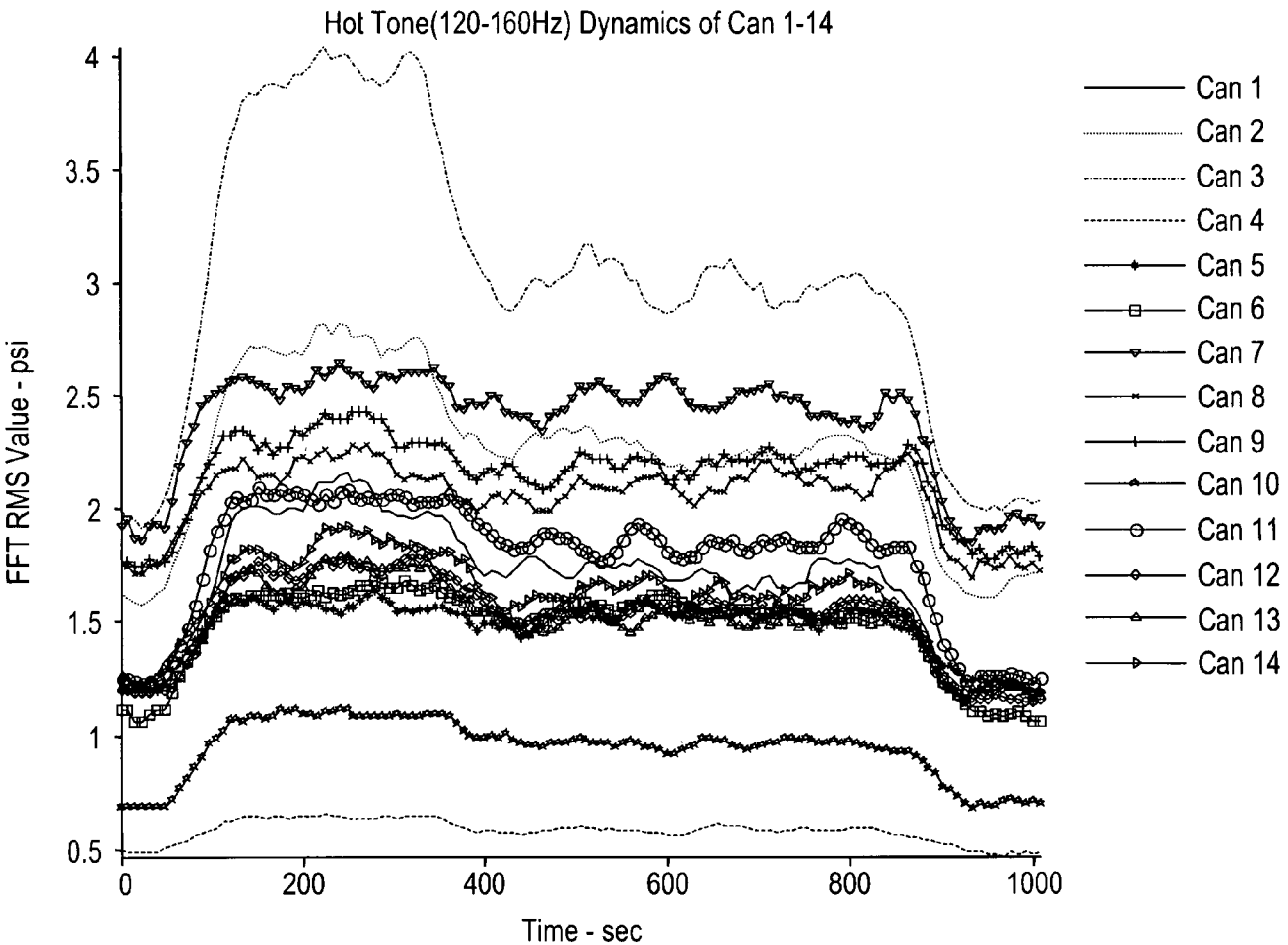
FIG. 9 shows hot tone trend in response to a global PM3 split scan.
Figure 10:
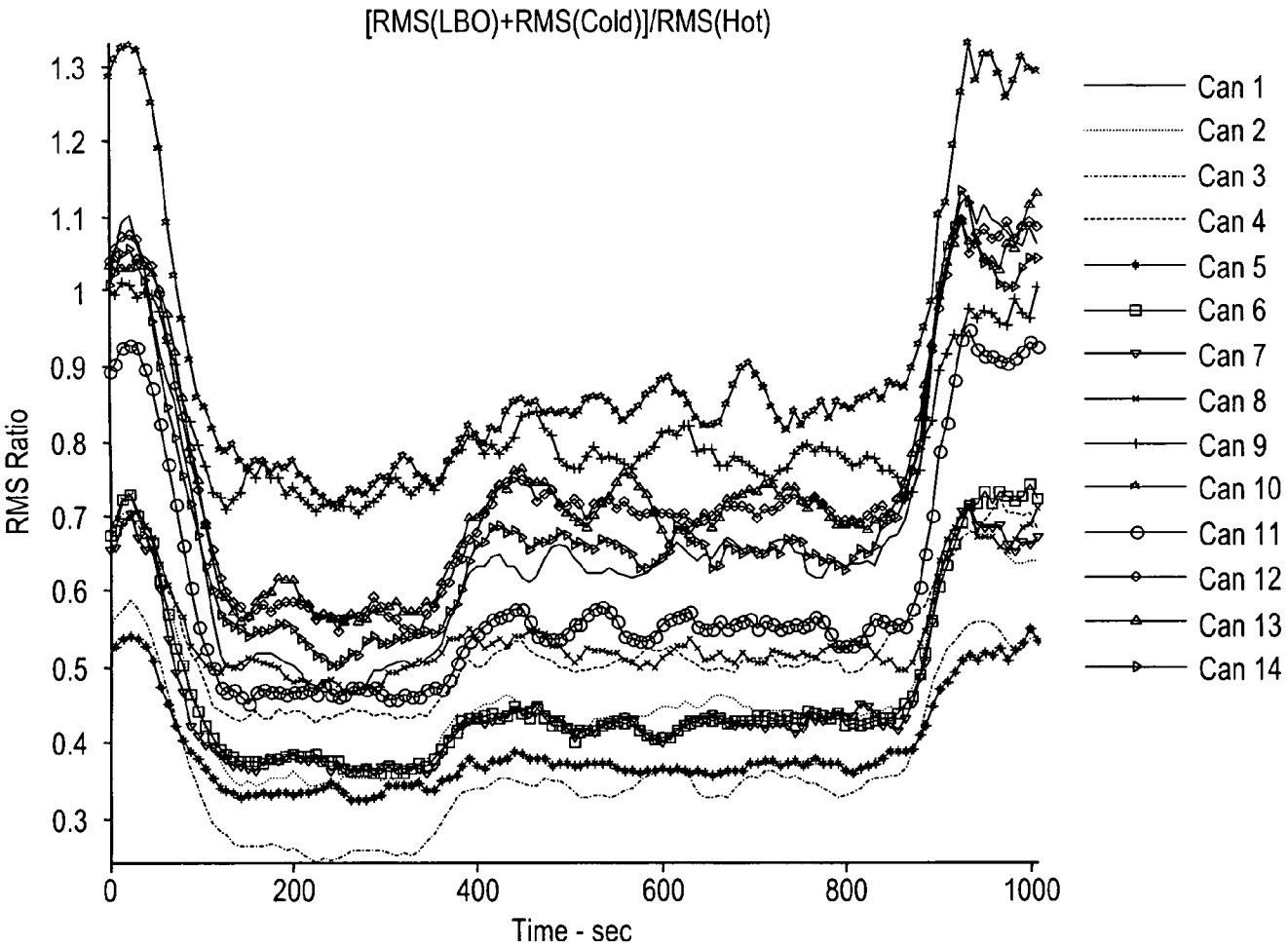
FIG. 10 shows RMS ratio ($\alpha$) trend in response to a global PM3 split scan.

The identification of "hot" and "cold" combustion chambers or cans 20 is dependent upon the distribution of the CSI 46 index from the diagnostic split scan. For outlier cans 52 that are hot, the hot tone RMS 30 may be used as a CSI index since a hot can shows high hot tone 30. However, for an outlier can 52 that is cold, it would have weaker energy in terms of Hot Tone 30 dynamics while being stronger in LBO Tone 34 and Cold Tone 32. Thus, RMS ratio α 48 may be used to locate an outlier can 52 that is cold. Thus, depending upon at what end of stratification, hot or cold, needs to be assessed, the appropriate basis based CSI can be selected to identify outliers as well as establish average cans in terms of dynamics. FIG. 9 shows the Hot Tone RMS 30 trend and FIG. 10 shows the RMS ratio α 48 trend during a global PM3 fuel split scan at base load. Can 3, can 2 and can 7 are the hot cans identified by using CSI based upon Hot Tone RMS 30. Can 10, can 12, can 9 and can 13 are the cold cans that can be identified from the RMS ratio α 48 trend.

With the background of CSI and the fuel system established, an exemplary method for correlation of CSI variation to individual fuel flow variation can be given as below.

Two key contributors are identified for one specific can variation reduction as total fuel flow Bulkcani and PM3 fuel split at can level % $PM3_{cani}$. Thus, by using CSI 46 and by tuning the fuel splits 46 based on CSI 46, can-to-can variation is reduced as a result. A quantified correlation of % change in can level PM3 or % change in can level total fuel with appropriate CSI basis can be made. Thus, using this quantified relation, and by using constrained optimization algorithms such as quadratic programming, it can be determined how much fuel flow or fuel split change should be made for each can to achieve CSI variation reduction, which is the measure of can to can variation. The constraints for this opitmization are the operational limits on fuel flow and split at the tubine and can level for the given operation along with the physical limits of the valves or any other device that is being used to change fuel flow at the can level. A transfer function that maps the valve position or the trim device to fuel flow can be built using appropriate valve/trim device flow versus position (number of turns for a valve) model. For example, for one particular turbine site, the quantified relationship between RMS (alpha) ratio based CSI and can level PM3 split and bulk fuel was found to be $CSI_{alpha}$=0.43*can level PM3+0.2*can level bulk+2.3*can level PM3*can level bulk. This relationship was valid for all the cans. Thus, using this relation, optimal can level bulk fuel and can level PM3 split can be found that minimizes the spread of $CSI_{alpha}$ across the cans. Once the optimal can level PM3 and can level bulk fuel settings are known, these can translated to valve positions or orifice plates that can be inserted in the flow paths if the valves are not used. The latter is a less flexible but considerably less costly option.

Figure 11:
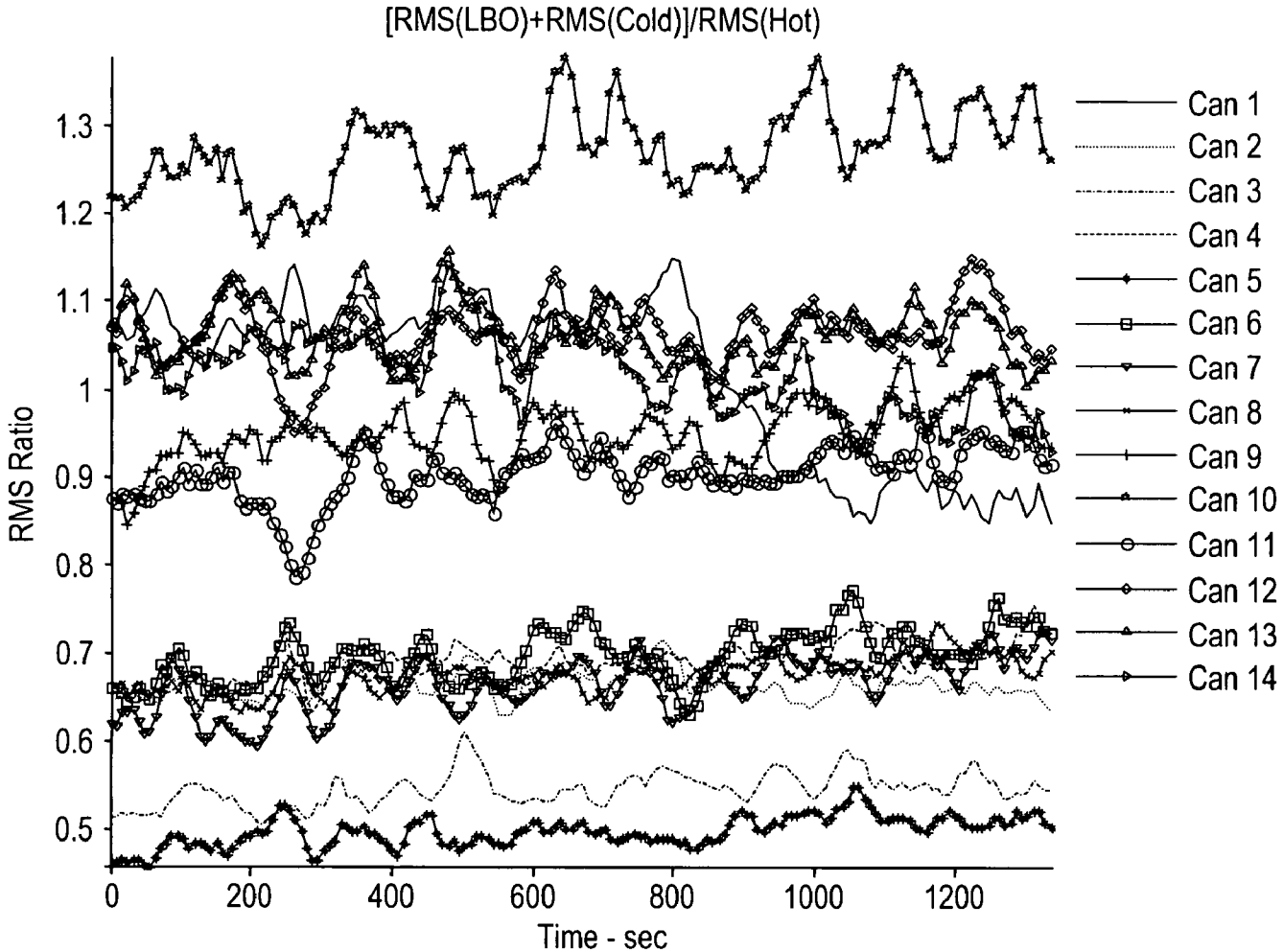
FIG. 11 is a graph showing the tuning of can 1 to be hotter based on alpha (RMS ratio) based CSI.
Figure 12:
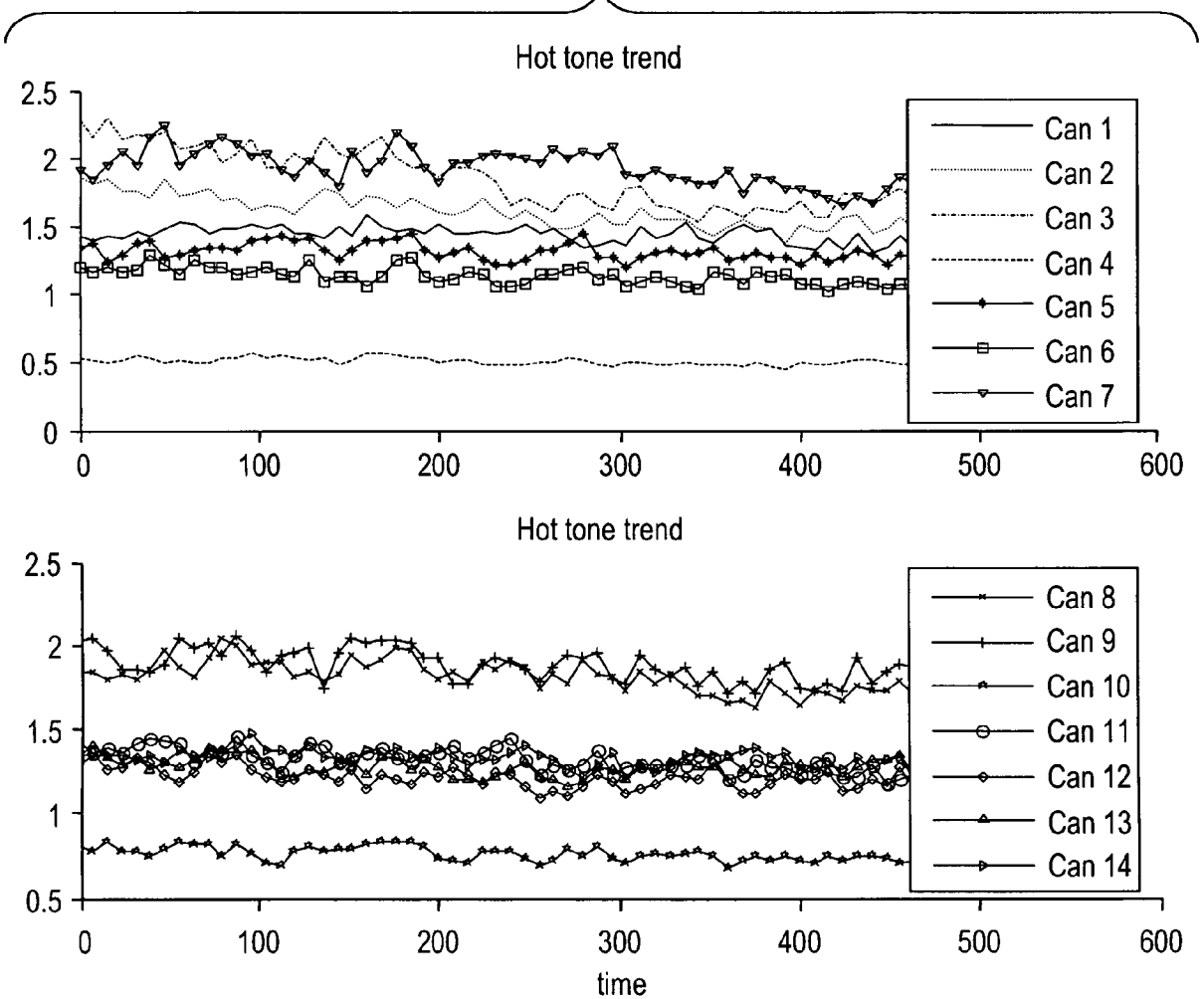
FIG. 12 is graph showing the tuning of can 3 to be colder based on RMS Hot Tone based CSI.

Exemplary results of tuning are shown in FIGS. 11 and 12. In FIG. 11, Can 1 was tuned by using CSI based on RMS ratio α and was made hotter. Clearly, the RMS ratio α decreases as expected as the can is made hotter. In FIG. 12, Can 3 was made colder using the Hot Tone RMS value based CSI. As expected, the hot tone of Can 3 decreased as the can was made colder.

Figure 13:
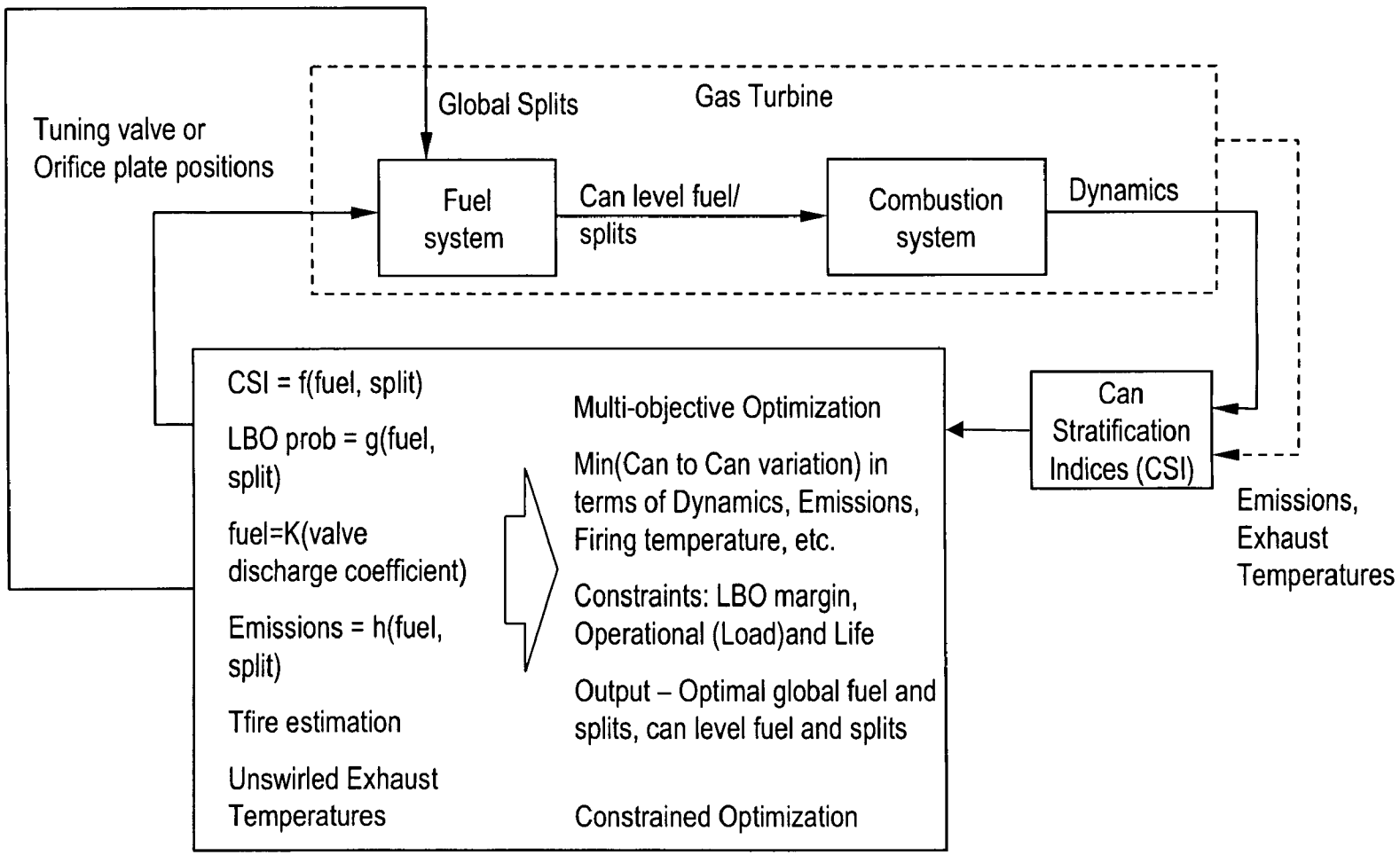
FIG. 13 is a flow chart of CSI driven can-to-can variation tuning.

This invention may reduce can-to-can variability by tuning global or can level splits or bulk fuel using CSI in order to ensure uniform life degradation of all the cans as well as provide more efficient turbine operation. An embodiment can be summarized into following important parts: A. The identification of a metric to correlate with the can-to-can variation that exists in a multiple-chamber combustion gas turbine system—we refer to this as the CSI or Can (or Combustion) Stratification Index. B. A method of constructing a CSI metric for a combustion chamber from the combustor dynamic tones when the unit is put through a diagnostic fuel split scan. C. The correlation of CSI variations to individual can fuel/air ratio variations. D. The method of reducing can-to-can variation by tuning the CSI of each combustion chamber (in a way, tuning the fuel flow of each can to reduce can to can variation in terms of dynamics), and E. The method of tuning the CSI of each combustion chamber by using flow trim devices in the gas fuel supply path to the combustion chamber. FIG. 13 summarizes the scheme. The tuning is treated is constrained optimization problem of minimizing CSI variation across the 14 cans subject to Lean Blowout (LBO) Probability of each can to be less than certain value and subject to constraint imposed by consumption of each can's life. The LBO probability for each can is estimated using the LBO tone. The closer a can is to an LBO stronger is the LBO tone. Thus, this tone amplitude can be used to assess the LBO probability for each can, which indicates the probability of blowing out. Some other spectral signatures such increase in hot tone frequency shift ($\beta$) and increase in RMS ratio $\alpha$ are also used to estimate LBO probability. The LBO probability constraint, ensure that the cans maintain certain LBO margin. The transfer functions that feed the optimization are fuel flow as a function of valve discharge coefficient or orifice plate parameters or appropriate fuel trim device parameters, LBO probability, life usage of can estimated using estimated firing temperature of each can, and CSI as function of fuel flow or splits. The life constraint will be decided by the desired maintenance cycle of the gas turbine. Typically, the combustion inspection intervals need to be respected and it is not desired to overfire the combustors and bring the turbine down earlier than the interval for maintenance. As mentioned before, either tuning valves or orifice plates can be used to implement this optimization.

One of ordinary skill in the art can appreciate that a computer or other client or server device can be deployed as part of a computer network, or in a distributed computing environment. In this regard, the methods and apparatus described above and/or claimed herein pertain to any computer system having any number of memory or storage units, and any number of applications and processes occurring across any number of storage units or volumes, which may be used in connection with the methods and apparatus described above and/or claimed herein. Thus, the same may apply to an environment with server computers and client computers deployed in a network environment or distributed computing environment, having remote or local storage. The methods and apparatus described above and/or claimed herein may also be applied to standalone computing devices, having programming language functionality, interpretation and execution capabilities for generating, receiving and transmitting information in connection with remote or local services.

The methods and apparatus described above and/or claimed herein is operational with numerous other general purpose or special purpose computing system environments or configurations. Examples of well known computing systems, environments, and/or configurations that may be suitable for use with the methods and apparatus described above and/or claimed herein include, but are not limited to, personal computers, server computers, hand-held or laptop devices, multiprocessor systems, microprocessor-based systems, network PCs, minicomputers, mainframe computers, distributed computing environments that include any of the above systems or devices.

The methods described above and/or claimed herein may be described in the general context of computer-executable instructions, such as program modules, being executed by a computer. Program modules typically include routines, programs, objects, components, data structures, etc. that perform particular tasks or implement particular abstract data types. Thus, the methods and apparatus described above and/or claimed herein may also be practiced in distributed computing environments such as between different power plants or different power generator units where tasks are performed by remote processing devices that are linked through a communications network or other data transmission medium. In a typical distributed computing environment, program modules and routines or data may be located in both local and remote computer storage media including memory storage devices. Distributed computing facilitates sharing of computer resources and services by direct exchange between computing devices and systems. These resources and services may include the exchange of information, cache storage, and disk storage for files. Distributed computing takes advantage of network connectivity, allowing clients to leverage their collective power to benefit the entire enterprise. In this regard, a variety of devices may have applications, objects or resources that may utilize the methods and apparatus described above and/or claimed herein.

Computer programs implementing the method described above will commonly be distributed to users on a distribution medium such as a CD-ROM. The program could be copied to a hard disk or a similar intermediate storage medium. When the programs are to be run, they will be loaded either from their distribution medium or their intermediate storage medium into the execution memory of the computer, thus configuring a computer to act in accordance with the methods and apparatus described above.

The term "computer-readable medium" encompasses all distribution and storage media, memory of a computer, and any other medium or device capable of storing for reading by a computer a computer program implementing the method described above.

Thus, the various techniques described herein may be implemented in connection with hardware or software or, where appropriate, with a combination of both. Thus, the methods and apparatus described above and/or claimed herein, or certain aspects or portions thereof, may take the form of program code or instructions embodied in tangible media, such as floppy diskettes, CD-ROMs, hard drives, or any other machine-readable storage medium, wherein, when the program code is loaded into and executed by a machine, such as a computer, the machine becomes an apparatus for practicing the methods and apparatus of described above and/or claimed herein. In the case of program code execution on programmable computers, the computing device will generally include a processor, a storage medium readable by the processor, which may include volatile and non-volatile memory and/or storage elements, at least one input device, and at least one output device. One or more programs that may utilize the techniques of the methods and apparatus described above and/or claimed herein, e.g., through the use of a data processing, may be implemented in a high level procedural or object oriented programming language to communicate with a computer system. However, the program(s) can be implemented in assembly or machine language, if desired. In any case, the language may be a compiled or interpreted language, and combined with hardware implementations.

The methods and apparatus of described above and/or claimed herein may also be practiced via communications embodied in the form of program code that is transmitted over some transmission medium, such as over electrical wiring or cabling, through fiber optics, or via any other form of transmission, wherein, when the program code is received and loaded into and executed by a machine, such as an EPROM, a gate array, a programmable logic device (PLD), a client computer, or a receiving machine having the signal processing capabilities as described in exemplary embodiments above becomes an apparatus for practicing the method described above and/or claimed herein. When implemented on a general-purpose processor, the program code combines with the processor to provide a unique apparatus that operates to invoke the functionality of the methods and apparatus of described above and/or claimed herein. Further, any storage techniques used in connection with the methods and apparatus described above and/or claimed herein may invariably be a combination of hardware and software.

While the methods and apparatus described above and/or claimed herein have been described in connection with the preferred embodiments and the figures, it is to be understood that other similar embodiments may be used or modifications and additions may be made to the described embodiment for performing the same function of the methods and apparatus described above and/or claimed herein without deviating therefrom. Furthermore, it should be emphasized that a variety of computer platforms, including handheld device operating systems and other application specific operating systems are contemplated, especially given the number of wireless networked devices in use.

What is claimed is:

1. A method for reducing combustion chamber to chamber variation in a multiple-combustion chamber turbine system comprising:

sensing dynamic combustion pressure tones emitted from combustion chambers in a multiple combustion chamber turbine;

determining a combustion chamber stratification index for the combustion chambers from the dynamic combustion pressure tones emitted for the combustion chambers to record combustion chamber performance variations in the multiple-chamber combustion turbine system; and reducing combustion chamber performance variations by tuning a fuel supply and/or fuel split to at least one selected combustion chamber subject to constraints wherein the combustion chamber stratification index is used to identify the at least one selected combustion chamber to be tuned.

2. The method of claim 1 further comprising:

normalizing the combustion chamber stratification index between a value of 1 and −1.

3. The method of claim 1 further comprising:

displaying the combustion chamber stratification index as a plot showing combustion chambers with a greatest performance deviation as outlying points on the plot.

4. The method of claim 1 further comprising:

performing a diagnostic fuel split scan when computing the combustion stratification index;

recording first levels of the dynamic combustion tones at a reference level of fuel split;

recording second levels of the dynamic combustion tones at a bias level of fuel split; and determining the combustion chamber stratification index by comparing the first levels to the second levels to determine combustion chamber performance variations.

5. The method of claim 1, wherein tuning a fuel supply and/or fuel split comprises using a constrained optimization method.

6. The method of claim 1 wherein the tuning of the fuel supply includes adjusting flow trim devices that are unique to each combustion chamber in a fuel supply path to the combustion chamber.

7. The method of claim 1 further comprising:

determining a correlation of the combustion chamber stratification index to individual combustion chamber fuel/air ratio variations to aid in combustion chamber performance variation tuning.

8. The method of claim 1 further comprising forming a fuel flow model wherein a fuel flow model is formed based on the fuel flow to each combustion chamber and the fuel flow model and the combustion chamber stratification index are correlated to each other to aid in combustion chamber performance variation tuning.

9. The method of claim 1 wherein the combustion chamber stratification index is based on dynamic combustion pressure tones associated with combustion chambers combusting at temperatures, which are hotter, colder than or equal to an average combustion chamber temperature.

10. The method of claim 1 wherein the combustion chamber stratification index is based on dynamic combustion pressure lean blow out (LBO) tones associated with combustion chambers burning at combustion chamber temperatures that are associated with a near lean blow out (LBO) state.

11. The method of claim 1 wherein the combustion chamber stratification index is based on dynamic combustion pressure tones associated with combustion chambers combusting at temperatures that are hotter than an average combustion chamber temperature and having a center frequency $f_c$.

12. The method of claim 1 wherein the combustion chamber stratification index is based on dynamic combustion pressure tones associated with combustion chambers combusting at temperatures that are different than or equal to an average combustion chamber temperature; and according to the formula $CSI_i(t)=\Delta_i(t)=\alpha_i(t)-\alpha_{avg}(t)$ where $\alpha=(RMS_{LBO}+RMS_{COLD})/RMS_{COLD}$.

13. The method of claim 1 wherein the combustion chamber stratification index is based on dynamic combustion pressure tones associated with combustion chambers combusting at temperatures that are hotter than an average temperature; and is based on a Beta factor $\beta$ where $\beta=(f_u-f_c)/(f_c-f_l)$ where $f_c$ is the estimated center frequency of a Hot Tone, and where, $f_u$ is the upper band of the Hot Tone frequency and $f_c$ is a constant.

14. The method of claim 1 wherein the combustion chamber stratification index is determined based on a percentage change of at least one of the dynamic tones from an averaged value.

15. The method of claim 1 wherein the combustion chamber stratification index is based on firing temperature of the combustor chamber estimated according to a relation wherein the higher the transverse acoustic tone frequency (temperature tone frequency) Trans_freq, the higher the temperature of the combustion chamber.

16. The method of claim 1 wherein a life usage of the combustor chamber is estimated according to a relation wherein the higher a transverse acoustic tone frequency Trans_freq, the higher the rate of life usage of the combustion chamber.

17. A method for reducing combustion chamber to chamber variation in a multiple-combustion chamber turbine system comprising:

sensing dynamic combustion pressure tones emitted from combustion chambers in a multiple combustion chamber turbine;

determining a combustion chamber stratification index for the combustion chambers from the dynamic combustion pressure tones emitted for the combustion chambers to record combustion chamber performance variations in the multiple-chamber combustion turbine system; and reducing combustion chamber performance variations by tuning a fuel supply and/or fuel split using a control system driving flow trim devices that are unique to each combustion chamber in a fuel supply path to the combustion chamber, to at least one selected combustion chamber subject to constraints wherein the combustion chamber stratification index is used to identify the at least one selected combustion chamber to be tuned.

* * * * *